United States Patent [19]

Kamijo

[11] 4,022,013

[45] * May 10, 1977

[54] REGULATING DEVICE FOR ELECTRIC TIMEPIECES

[75] Inventor: Noriyuki Kamijo, Nagano, Japan

[73] Assignee: Kabushiki Kaisha Suwa Seikosha, Tokyo, Japan

[ * ] Notice: The portion of the term of this patent subsequent to July 10, 1990, has been disclaimed.

[22] Filed: Jan. 22, 1974

[21] Appl. No.: 435,567

Related U.S. Application Data

[63] Continuation-in-part of Ser. No. 232,326, March 2, 1972.

[52] U.S. Cl. ..... 58/23 R; 58/85.5; 58/23 D

[51] Int. Cl.[2] ..... G04C 3/00

[58] Field of Search ..... 58/85.5, 34, 23 R, 23 BA, 58/23 A, 23 D, 28 R; 331/116 R

[56] References Cited

UNITED STATES PATENTS

| | | | |
|---|---|---|---|
| 3,059,412 | 10/1962 | Epperlein | 58/28 R |
| 3,664,118 | 5/1972 | Walton | 331/116 R |
| 3,690,058 | 9/1972 | Kurita | 58/23 R |
| 3,691,753 | 9/1972 | Kurita | 58/85.5 X |
| 3,744,234 | 7/1973 | Kamijo | 58/34 |
| 3,762,153 | 10/1973 | Komiyama et al. | 58/85.5 X |
| 3,813,873 | 6/1974 | Nakagawa | 58/85.5 |

FOREIGN PATENTS OR APPLICATIONS

| | | | |
|---|---|---|---|
| 1,094,666 | 12/1960 | Germany | 58/85.5 |

*Primary Examiner*—Ulysses Weldon
*Attorney, Agent, or Firm*—Blum, Moscovitz, Friedman & Kalan

[57] ABSTRACT

An electric timepiece having an electro-mechanical transducer for driving a mechanical time display arrangement intermittently in response to a pulse signal applied to the transducer from an electric driving circuit. A regulating device is provided having an externally and coordinately operated mechanical control member and reset switch adapted to apply a pulse of a polarity suitable to energize the transducer one second after the reset switch is returned to its normal position from its resetting position. Improved driving of mechanical gears is provided by having the gear train mounted to the same bridge member as a gear which imparts one-way motion thereto.

11 Claims, 10 Drawing Figures

REGULATING DEVICE FOR ELECTRIC TIMEPIECES

CROSS REFERENCE TO RELATED APPLICATION

This application is a continuation-in-part of application Ser. No. 232,326 filed Mar. 2, 1972.

BACKGROUND OF THE INVENTION

This invention relates to a regulating device for electric timepieces having electro-mechanical transducers, and in particular, to electric watches incorporating such transducers. In such timepieces, a step motor is provided driven by a signal supplied by an oscillating driving circuit which may include a crystal vibrator. A second hand is incrementally driven at one second intervals by the rotor of the transducer, which rotor is provided with alternately magnetized north and south poles and is positioned between a pair of stators. By changing the magnetic polarity produced in the stators in response to the pulse signal produced by the driving circuit, magnetic repulsion and attraction between the rotor and stator is produced and the rotor is incrementally driven once each second.

Generally, this type of timepiece is provided with a reset circuit and a regulating lever. The reset circuit has two functions, namely to cut off the flow of driving current to the coil of the electro-mechanical transducer when the reset switch is turned on, and to apply a predetermined positive or negative first driving pulse to the coil when the reset switch is turned off. The regulating lever also serves two functions. Thus, by cooperation with a regulating cam, it determines the position of the magnetic poles of the rotor relative to the stator in order that the pulse of the rotor may be arranged favorably for the operation of the rotor in view of the magnetic polarity produced in the stator by the first driving pulse produced when the reset circuit is operated. Further, the regulating lever stops the rotor so that the hour and minute hands may be manually adjusted and reset without disturbing the position of the rotor through the operation of a friction clutch arrangement between the hour and minute hands and the rotor.

Quartz crystal timepieces are highly accurate, and even a compact-size quartz crystal watch can be adjusted to a daily rate of about $\pm 0.2$ second. However, over a period of tens of days, the error will be accumulated and may become large. In such instances, it will be necessary to adjust the time indication. However, the prior art regulating devices have themselves introduced errors into the time keeping due to the locking of the mechanical time indication arrangement by the regulating lever at the time of the application of the first driving pulse to the coil of the transducer.

SUMMARY OF THE INVENTION

Generally speaking, in accordance with the invention, an electronic timepiece is provided having an electro-mechanical transducer for incrementally advancing a mechanical time indication means at one second intervals in response to a pulse signal supplied to said transducer from a driving circuit. A regulating device is provided having a reset switch operatively coupled to said driving circuit, a regulating lever positioned for displacement into and out of interfering engagement with a mechanical element to selectively fix the rotor of said transducer; and means for coordinately operating said reset switch and regulating lever.

Said driving circuit and reset switch is adapted such that the first operative driving pulse applied to the transducer is applied at about one second after the release of said reset switch from its resetting position.

The regulating device is preferably formed with a single pivotably mounted member defining said regulating lever and the moving contact of said reset switch and is preferably shaped and positioned such that the regulating lever portion of said member is positioned in interfering engagement so as to stop the rotor before said reset switch is closed, while said reset switch is first opened and said regulating lever portion is then returned to a position out of interfering engagement after resetting.

The mechanical element for fixing the rotor is a regulating cam mounted on the same shaft as said rotor. A transducer element is mounted to the rotor and regulating cam shaft and imparts a one-way rotational movement to a one-way member which is adapted to drive the gear train and is mounted to the same bridge as at least one gear of said gear train driven by said one-way member.

Accordingly, it is an object of this invention to provide a regulating device for an electronic timepiece wherein the first operative pulse after resetting is consistently applied at a time at which the regulating lever is out of its interfering engagement position with said regulating cam at which the rotor of the electromechanical transducer of the timepiece is stopped.

It is a further object of this invention to improve the drive train movement in an electronic timepiece by mounting the gears thereof on the same bridge with a one-way motion driving transducer for driving the gears in a single rotary direction.

Still other objects and advantages of the invention will in part be obvious and will in part be apparent from the specification and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
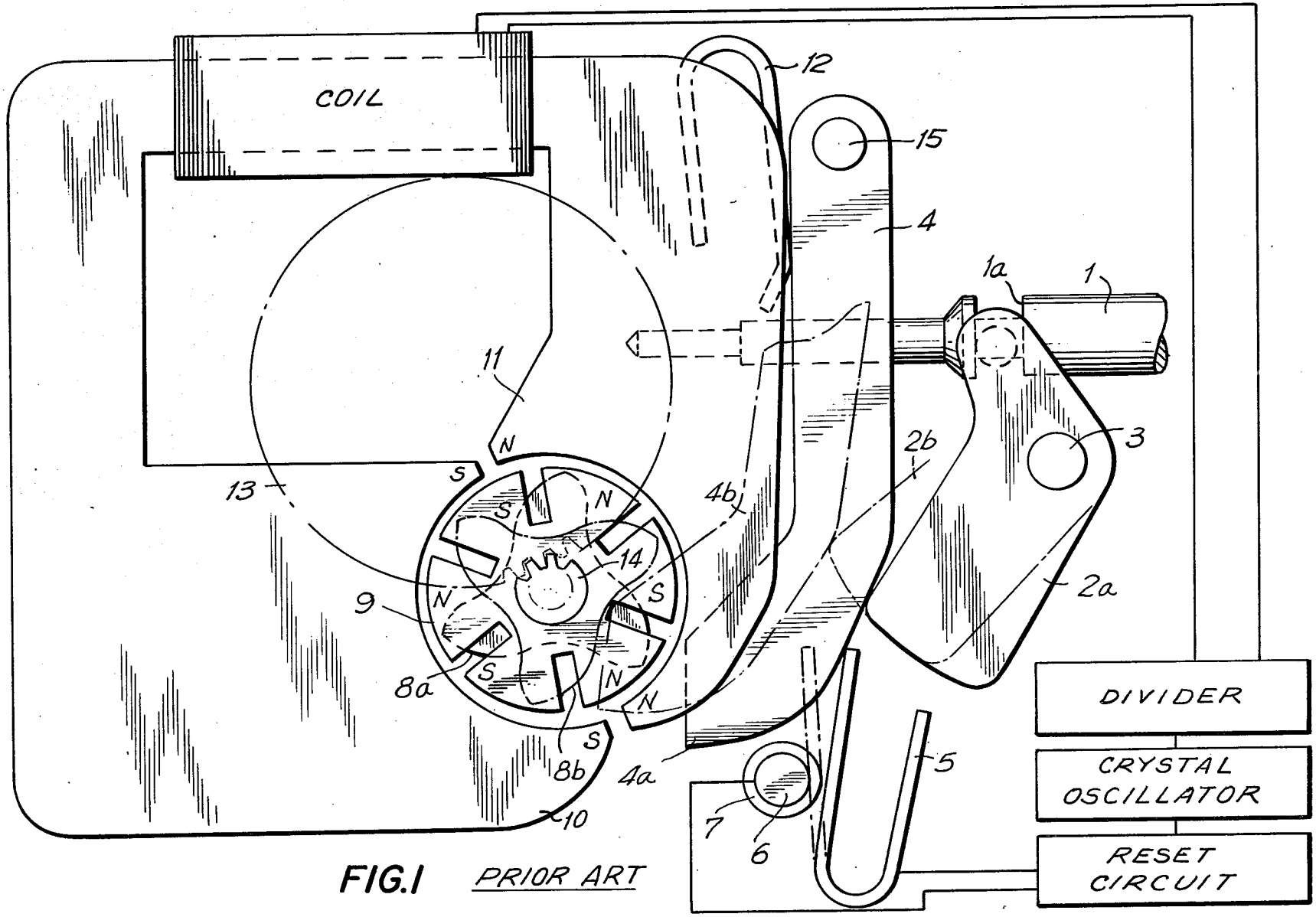
FIG. 1 PRIOR ART
FIG. 1 is a partially schematic, partially top plan view of a prior art regulating arrangement for electronic timepieces.
Figure 2:
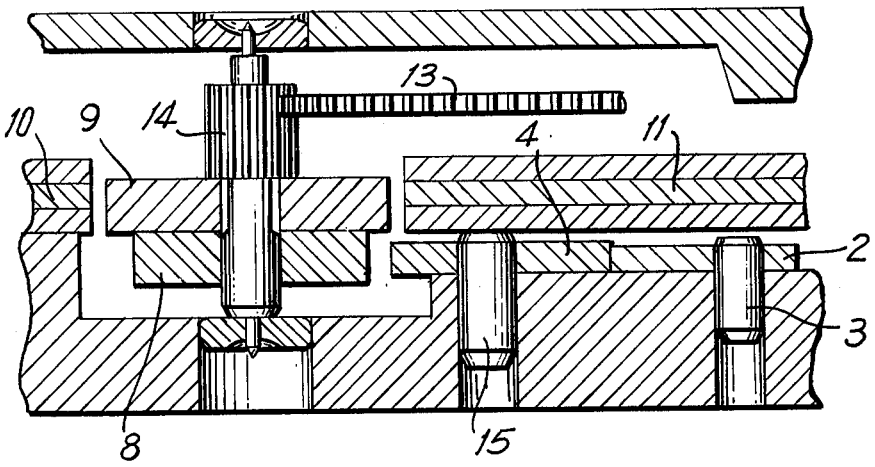
FIG. 2 PRIOR ART
FIGS. 2 and 3 are fragmentary sectional views of portions of the regulating arrangement of FIG. 1.
Figure 3:
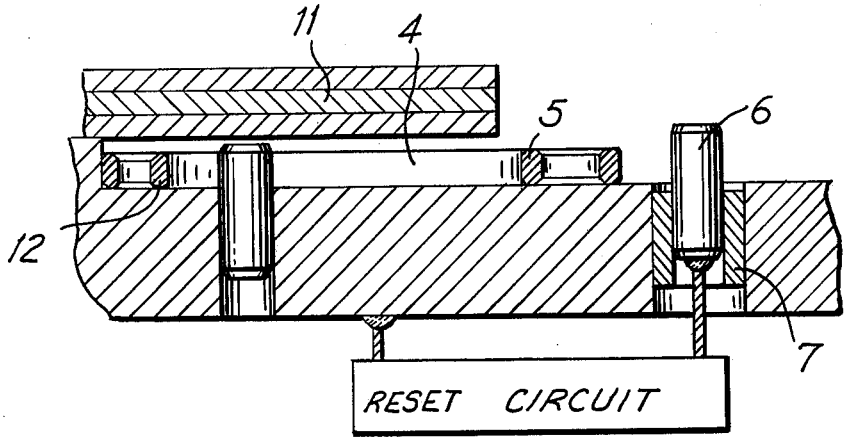
FIG. 3 PRIOR ART

Referring now to FIGS. 1–3, a prior art regulating device for electronic timepieces is depicted. Said timepiece, which is in the form of a watch, is provided with a second hand (not shown) mounted on the axis of fourth wheel 13, which is engaged and driven by rotor pinion 14. When stem 1 is pulled out, the position of regulating lever 4 is moved from position 4*a* shown in full lines to the position 4*b* shown in phantom line and the position of regulating cam 8 is fixed in the position 8*b* also shown in phantom lines. The rotor 9 of the electro-mechanical transducer consists, in this embodiment, of a permanent magnet having six circumferentially spaced poles of alternate magnetic polarities. The polarities indicated in the embodiment of FIG. 1 on rotor 9, as well as the polarities indicated at the poles of stator 11, are such as to cause rotor 9 to be incrementally advanced in the clockwise direction, as viewed in FIG. 1, an incremental distance represented by the length of one of the poles on said rotor, and representative of a one second increment advance by the second hand. The electronic timepiece is provided with a driving circuit which includes a crystal oscillator for producing a high frequency time standard signal and a divider circuit for dividing said high frequency time standard signal into a low frequency timing signal, preferably having a frequency of one second which is applied to the coil of the electro-mechanical transducer. A reset circuit is associated with said crystal oscillator and divider, one terminal of said reset circuit being electrically connected to the movable contact 5 of a reset switch through the plate of the watch as more particularly shown in FIG. 3, while the other terminal of the reset circuit is connected to a fixed contact pin 6 mounted in said plate but insulated therefrom by means of an insulating bush 7. Whenever movable contact 5 engages pin 6, the reset circuit is turned on. The reset and driving circuits are adapted such that when the reset switch is opened, a driving pulse is applied to the coil such as to produce a polarity in the poles of stator 11 which will incrementally advance said rotor by one increment. Thus, when the resetting lever is in the position 4*b*, regulating cam 8 is in the position 8*b* and rotor 9 would be rotated by one pole in the clockwise direction from the position depicted in FIG. 1. In this prior art arrangement, at the instant that the reset switch is opened, a driving pulse is applied to the coil such that the polarity of the poles on the stator corresponds to that depicted in FIG. 1 so that the magnetic driving force would be immediately applied to rotate the rotor 9 by one increment.

The regulating cam is provided with a number of projections equal to one half the number of poles of the rotor and aligned to position selected ones of the poles of the rotor in registration with the poles of the stator so as to insure immediate driving of the rotor.

In the prior art arrangement of FIGS. 1–3, the stem 1 would be pulled out at the moment that the second hand nearly indicates 59 seconds. An operating lever 2 having a dowel engaged in a cut-away portion 1*a* of the stem rotates about a pin 3 inserted in the plate of the watch to move from position 2*a* shown in full lines to position 2*b* shown in phantom lines. As operating lever 2 pushes regulating lever 4, said regulating lever rotates in the direction of position 4*b* about pin 15 against the force of regulating lever spring 12, which serves to normally maintain said regulating lever in position 4*a*. Before regulating lever 4 is placed in interfering engagement with regulating cam 8, movable contact 5 of the reset switch engages the fixed pin due to the natural spring force thereof and the reset switch is turned on. The regulating lever thereafter reaches position 4*b* to engage the regulating cam.

When the second hand indicates 59 seconds, or any odd second indication, the regulating cam is positioned at position 8*b* and can be maintained at that position by the regulating lever. When the minute and hour hands are adjusted by means (not shown) while the regulating lever is in interfering engagement with the regulating cam, the rotor and the second hand will remain fixed due to the provision of friction clutch means (not shown) between the minute and hour hands and the rotor. This permits the adjustment of the minute and hour hands while the second hand remains at the 59 second location. The final adjustment of the second hand is achieved by pushing the stem to end resetting at the instant that the reference time indication device, such as a time signal, indicates 60 or 0 seconds. Pushing on stem 1, as a practical matter, can be achieved in an extremely short time, so that, in the arrangement of FIGS. 1–3, the rotor is driven by one step at the same time that the stem is pushed. Accordingly, the second hand would indicate 60 or 0 seconds simultaneously with the reference or time signal, the watch being thereafter driven in the normal manner with the second hand being incrementally rotated once each second. In this manner, the time can be set to a standard time.

Figure 6:
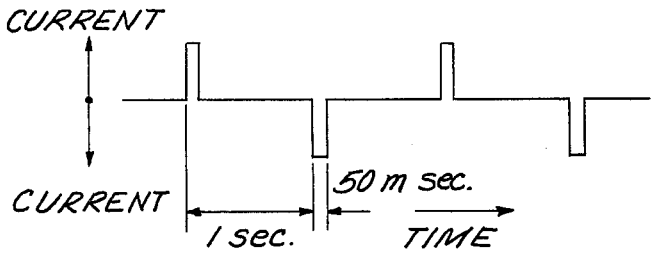
FIG. 6 is a wave form diagram of the inverse driving pulse applied from the driving circuit to the coil of the electromechanical transducer of the timepieces of FIGS. 1 and 4.

However, due to errors in dimensions of the parts of watches of the type depicted in FIGS. 1–3, the timing of the engagement and disengagement of the regulating lever from the regulating cam and the operation of the movable contact may be opposite from that intended by the designers of such watches. Thus, when the stem is pushed, the sequence of operation of the elements is such that the movable contact 5 is disconnected from pin 6 to turn the reset circuit off before the regulating lever 4 is completely disengaged from regulating cam 8. The reset switch is thus turned off and the first driving pulse is produced while the regulating lever is still in interfering engagement with said regulating cam. As shown in FIG. 6, the width of the normal driving pulse is 50 msec. If the time between the opening of the reset switch and the disengagement of the regulating lever is longer than 50 msec., the driving pulse will have ended by the time the regulating lever is disengaged from the regulating cam, so that the rotor cannot rotate. The second pulse produced 1 second later than the first driving pulse is of a polarity opposite to that of the first pulse and produces a polarity in the stator opposite to that required for driving the rotor and the rotor remains attracted to the stator, rather than being propelled therefrom for incremental advancement. The third pulse is similar to the first pulse, and serves to magnetize the poles of the stator such that the rotor is rotated in the clockwise direction by one incremental distance. However, at this point, the timepiece has already lost two seconds, and the correct time is not indicated. This effect would be produced, not only for resetting at the 59 second position, but also for all odd second position. If the stem is pulled out when the second hand shows an even second, the regulating lever will automatically displace the regulating cam, and therefore the rotor to the alignment associated with the odd-second position, insuring that operation will be as described above.

Figure 4:
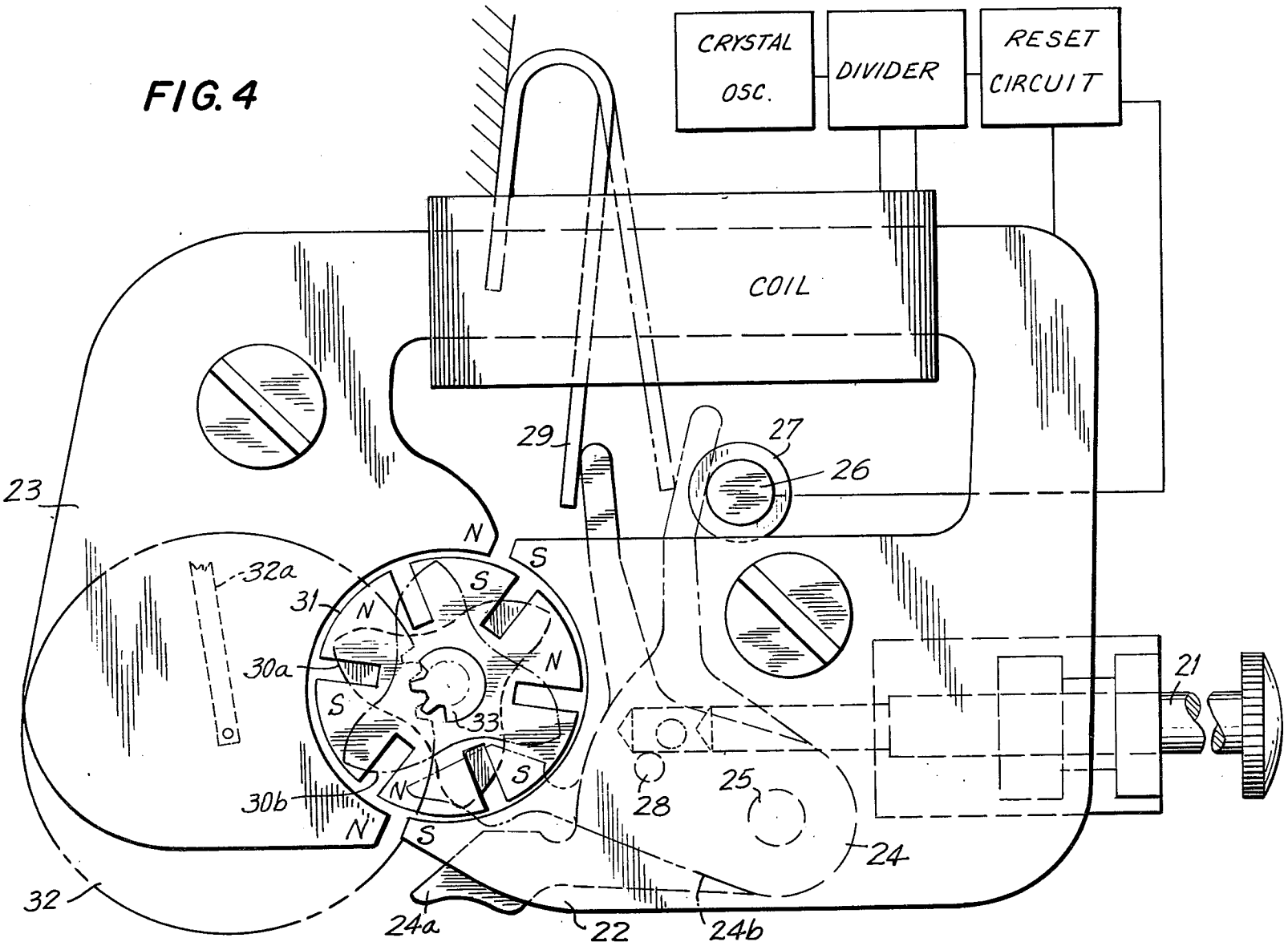
FIG. 4 is a partially schematic, partially top plan view of the regulating arrangement in accordance with the invention.
Figure 5:
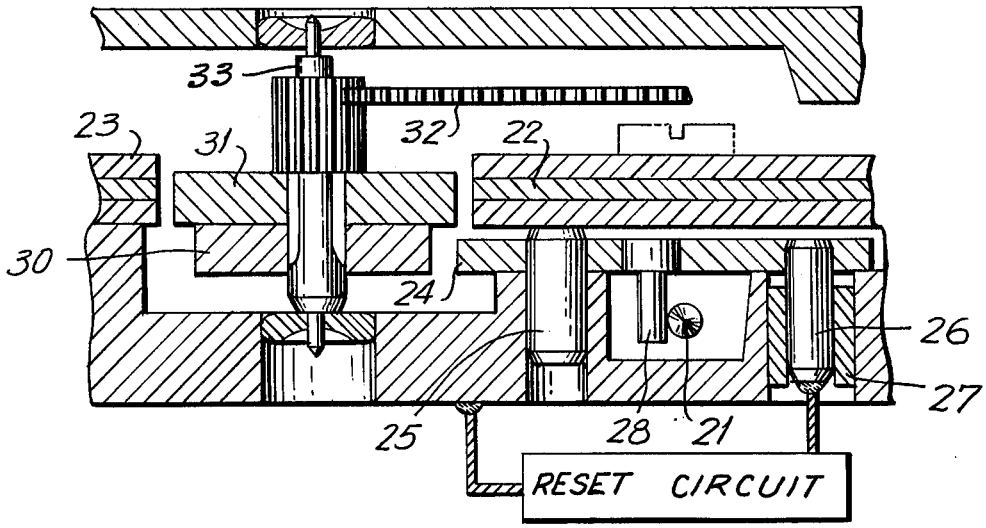
FIG. 5 is a fragmentary sectional view of a portion of the regulating assembly of FIG. 4.

The foregoing practical problem in the prior art arrangement is eliminated in the arrangement according to the invention depicted in FIGS. 4 and 5. In said embodiment, the watch depicted includes a stem 21, stators 22 and 23 mounted on the plate of the watch, and a regulating lever 24 pivotably mounted on the plate by means of a pin 25. A fixed contact pin 26 is mounted within an insulating bush 27 in the plate and electrically connected to one terminal of the reset circuit. A pin 28 is fixedly mounted on regulating lever 24 and positioned for engagement by stem 21 when said stem is in its pushed-in position. A regulating spring 29 engages regulating lever 24 to bias said regulating lever in the clockwise direction as viewed in FIG. 4. A regulating cam 30 is fixed to rotor pinion 33 and rotor 31, said assembly being incrementally advanced once each second in the clockwise direction as viewed in FIG. 4 during the operation of the watch. Rotor 31 is provided with six circumferentially spaced poles of alternate magnetic polarity, the three projections of regulating cam 30 being aligned so as to position the rotor in a predetermined position more particularly described below when engaged by the regulating lever.

The second hand of the watch 32*a* is mounted on the axis of fourth wheel 32 for engagement and driving by rotor pinion 33. In the arrangement of FIGS. 4 and 5, the second hand, rotor and regulating cam are aligned so that the regulating cam is positioned at the position 30*b* when the second hand indicates an even number of seconds, such as zero seconds. The other terminal of the reset circuit is connected to the plate of the watch, and through said plate to regulating lever 24.

Figure 9:
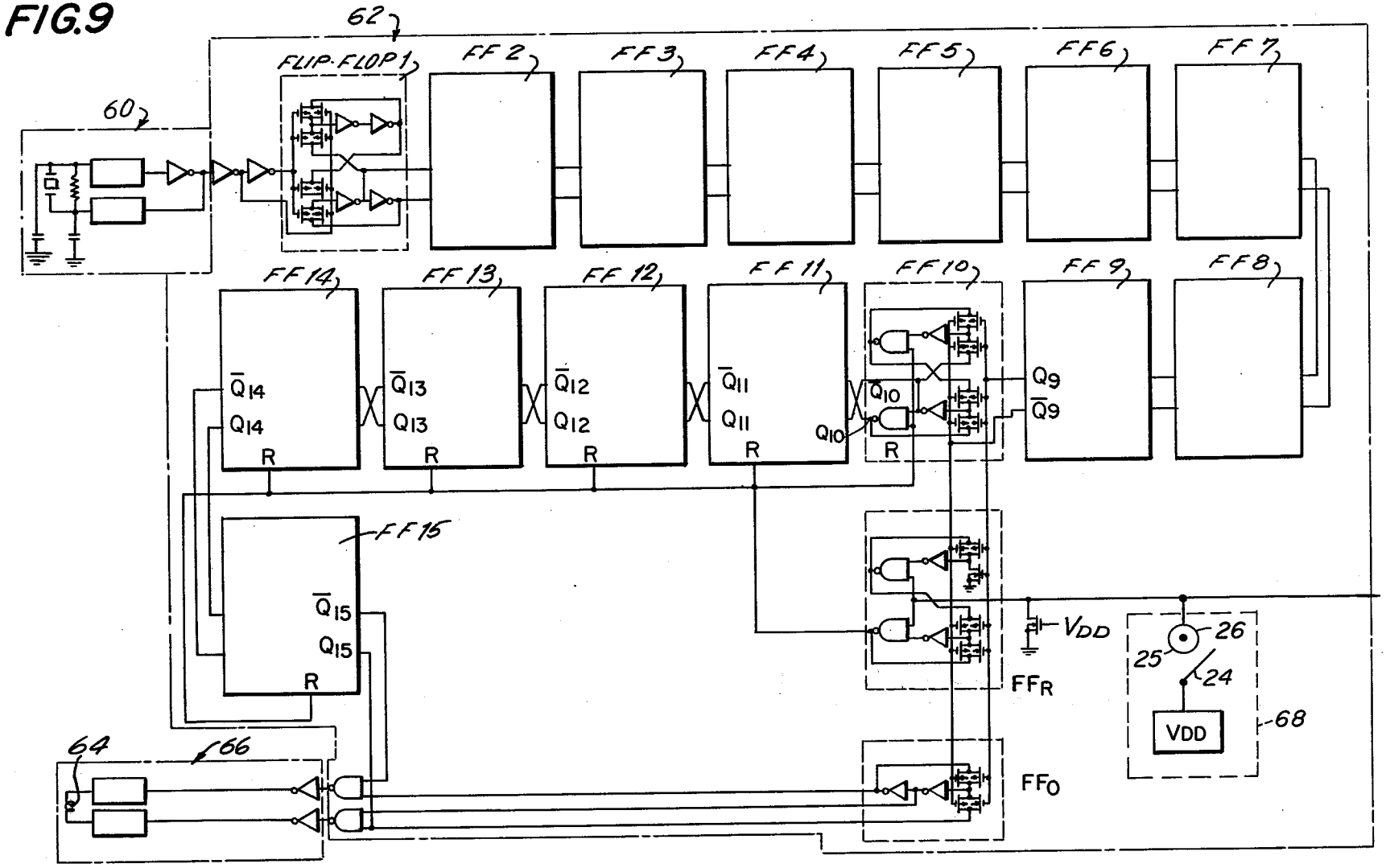
FIG. 9 is a block circuit diagram of the reset, oscillator and divider circuits in accordance with the invention.
Figure 10:
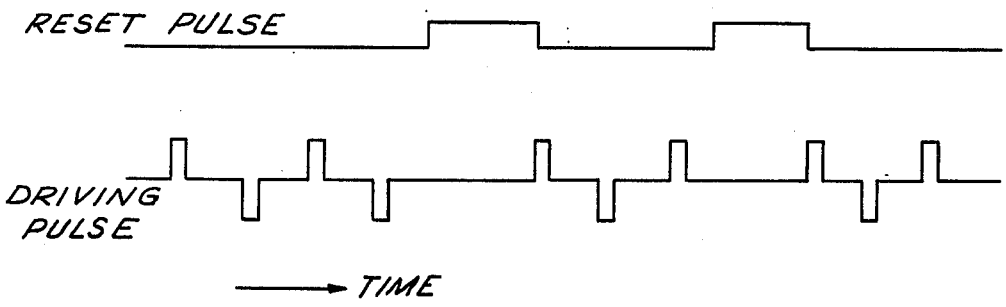
FIG. 10 is a wave diagram of the signals provided by the reset circuit and divider circuit depicted in FIG. 9.

Referring specifically to FIGS. 9 and 10, the oscillator, driving and reset circuit depicted in FIG. 4 are constructed in accordance with the instant invention. High frequency signals are generated by the quartz crystal oscillator circuit 60 and are applied through a plurality of two stage inverter circuits 62 which divide the high frequency signal into a two second alternating signal, which signal is depicted in FIG. 6. The 2 second alternating signal is applied to the stator coil 64 of the step motor 66 through a power amplifier and wave shaping circuits. The coil 64 applies the alternating signal to the stator poles 22 and 23 to drive the rotor in step-wise fashion every one second in response to the alternating pulses applied each second. A reset circuit 68 is coupled to one of the divider stages to apply a reset pulse shown in FIG. 10 thereto. Upon termination of the reset pulse, an application of the driving pulses to the coil is continued, the circuit producing a first pulse of the same predetermined polarity after the reset signal is terminated without regard to the polarity of the last pulse before reset. The desired polarity of the signal can be determined by simple logic circuitry as understood by the following explanation of the operation of FIG. 9.

Flip-flops $FF_{10}$ through $FF_{15}$ are series-connected master-slave divider stages each including a reset terminal R.

Referring to FIG. 4, the polarities indicated on the stator and rotor are not the polarities which would be normally present during the normal operation of the watch, but rather, the polarities of the stator and the rotor when regulating lever 24 is displaced from the regulating position to the normal position. Thus, in order to perform time adjustment in the timepiece in accordance with the invention, the stem 21 is pulled out to effect time adjustment when the second hand indicates zero seconds. At this position, the regulating cam is positioned at position 30*b*, and the polarity of the poles of the rotor is as shown in FIG. 4. When stem 21 is pulled out, said stem is disengaged from pin 28 so that the regulating lever moves from position 24*a* to position 24*b* due to the bias force of spring 29. The end of the regulating lever engages pin 26 to close the reset circuit to stop the application of timing signals to the coil of the electromechanical transducer. Simultaneously, the regulating lever engages regulating cam 30 and the second hand stops at the zero second position.

Unlike the prior art arrangements, when the stem 21 is pulled out, the regulating lever may begin to engage with the regulating cam before the reset circuit is turned on so that driving pulses are still being applied to the rotor. In such a case, only the second hand is not operated, and the time keeping circuitry of the watch continues to operate.

When the regulating lever is positioned at position 24*b*, the minute and hour hands (not shown) are adjusted first in a conventional manner. During such adjustment, the regulating lever acts to prevent the rotation of the third wheel and the second hand, rotation of the hour and minute hand being permitted by a friction clutch in the usual manner. After the hour and minute hands are adjusted, and if the stem is pushed in at the same moment as the reference or time signal, stem 21 will engage pin 28 to rotate regulating lever 24 in the counter clockwise direction, as viewed in FIG. 4, about pin 25. This rotation disengages the regulating lever from pin 26 to turn the reset circuit off.

Reference is made to FIGS. 9 and 10 wherein the reset circuit, and pulses produced thereby are depicted. As is appreciated, since a pulse of a predetermined polarity is applied at the termination of the reset pulse, the reset and divider circuits are adapted so that the first driving pulse produced by the divider circuit serves to magnetize the stator as shown by the north and south indications in FIG. 4, so that the rotor remains attracted to the stator and does not rotate in response to the initial pulse. During this interval, the regulating lever is displaced from interfering engagement with regulating cam 30. One second later, the second pulse of a polarity opposite from the initial driving pulse is applied to the stator to reverse the polarity of the poles thereof, and to incrementally advance the rotor by one increment representative of one second. Thus, the polarity of the stator would be opposite from that depicted in FIG. 4, and the rotor would rotate in the clockwise direction as viewed in FIG. 4 by a single increment. Thus, in the arrangement of FIGS. 4–5, one second after pushing the stem, the second hand indicates one second, and the displayed time corresponds to the reference or standard time.

Accordingly, as described above, the invention is characterized by the fact that when the stem is pushed, the reset switch is first opened, and the regulating lever then being disconnected from the regulating cam. Further, the driving and reset circuits are adapted to polarize the stator such that the rotor is attracted to the stator during the first second after the stem is pushed in so that one full second is allowed for the displacement of the regulating lever out of interfering engagement with the regulating cam. If this displacement is achieved within the alotted time, the watch can be operated normally without any trouble.

The pushing of the stem can be completed in a short time during normal operation, so that, in the arrangement of FIGS. 4–5, the regulating lever is completely disengaged from the regulating cam before the rotor begins to rotate in response to the second driving pulse, so that errors in the dimensions of the parts such as the dimensions of the regulating lever and stem, do not interfere with the normal operation of the rotor. The above-described operation could equally be performed for all even second indications, and is not limited to the point at which the second hand indicates zero seconds. When the second hand indicates an odd second so that the regulating cam is disposed at position 10*a*, the displacement of the stem automatically serves to displace the regulating cam to position 30*b* by operation of the oblique plane portion at the end of the regulating lever, positioning said rotor and regulating cam in the same position as if the stem had been pulled out at an even second. Thus, the operation when the stem is pushed corresponds to the operation at even second indication.

The sequence of operation of the arrangement according to the invention, namely the turning off of the reset circuit before the regulating lever is out of operative disengagement with the regulating cam permits the provision of the moving contact of the reset switch as a part of the regulating lever. This is not possible in the prior art arrangements due to the sequence requirements that the regulating lever must be disconnected before the reset switch is turned off.

A further advantage of the arrangement in accordance with the invention is that the fixed contact pin 26 serves to position and limit the operating range of regulating lever 24, so that the watch can be normally operated independent of errors in the size of the parts relating to the sequence of operation. Further, the arrangement in accordance with the invention offers substantial advantages in that it reduces the number of parts and adjustments required. Further, the arrangement in accordance with the invention, which requires operation of the winding stem at the zero second indication, corresponds to the conventional approach followed in regulating mechanical watches driven by balance wheels, which generally require the stopping of the second hand at the zero second position to effect adjustment, and pushing the winding stem at the instant of the reference or time signal. On the other hand, the prior art arrangements which require stopping the second hand at the 59 second position is unnatural and therefore inconvenient for users experienced in the operation of mechanical timepieces.

While the embodiment of the arrangement according to the invention depicted in the drawings utilizes a quartz crystal oscillator as the time standard signal generator and a step motor as the electro-mechanical transducer, the arrangement can be applied to any electric timepiece incorporating electromechanical transducer, even such timepieces as incorporate mechanical time display arrangements incorporating hands.

Figure 7:
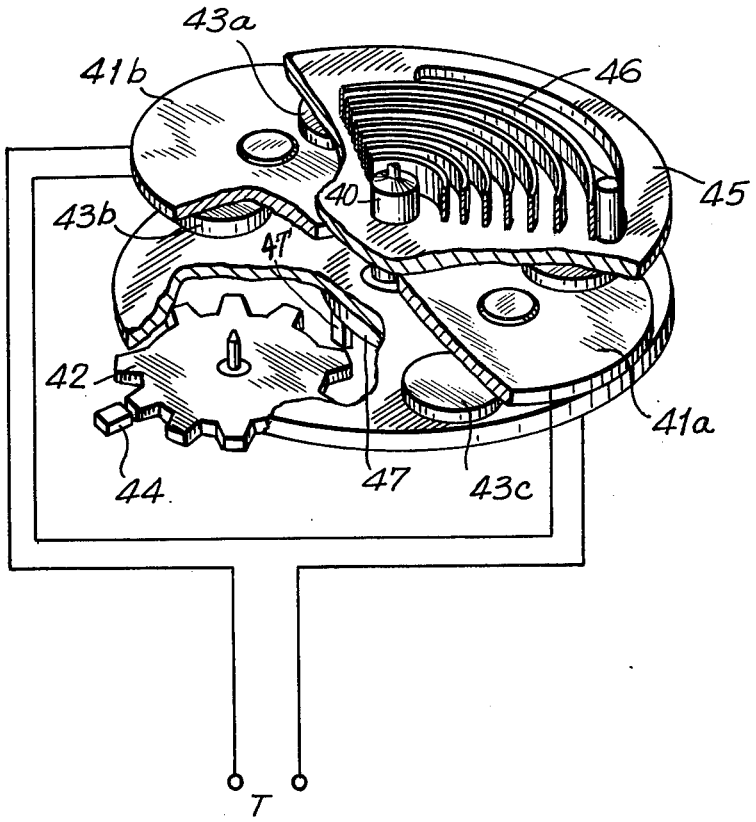
FIG. 7 is a partial perspective view of a balance wheel motor constructed in accordance with the instant invention.
Figure 8:
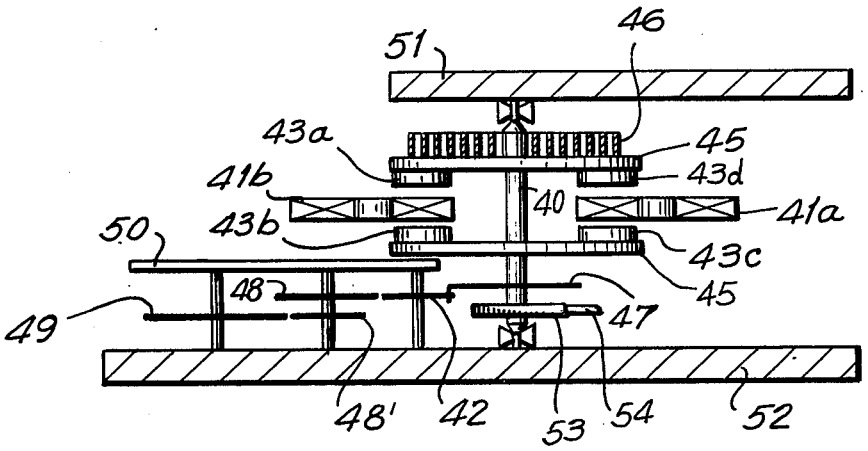
FIG. 8 is a schematic view of the gears in an electronic timepiece and the balance wheel motor for driving same depicted in FIG. 8.

Still another embodiment of the instant invention is depicted in FIGS. 7 and 8, wherein a reciprocating rotating balance wheel motor is utilized as an electromechanical transducer. A shaft 40, supports two balance wheel rotor plates 45 which have mounted thereto in opposing relationship two pairs of permanent magnets, 43*a* and 43*b*, and 43*c* and 43*d*. Drive coils 41*a* and 41*b* are disposed between the permanent magnets and provide the stator elements for driving the balance wheel rotor. A hairspring 46 is coupled to the rotor plate 45 and effects oscillating movement thereto. Also disposed on shaft 40 is a roller jewel 47 which includes a finger 47′ which is adapted upon the reciprocating oscillation of the balance wheel to provide one way rotary movement to a star escapement wheel 42. The star escapement wheel 42 is positioned by a magnet which maintains the preciseness of positioning during each stepping of the star escapement wheel. The two drive coils are connected in series, and output signals from the electronic divider circuit are applied to the synchronous signal terminal T.

Referring specifically to FIG. 8, a support bridge 50, rotatably supports the star escapement wheel 42, and the mechanical gear train gears 48 and 49 in the manner depicted. Thus, a one-way rotating member, namely star escapement wheel 42, is mounted on the same bridge as the gear train members, to convert the reciprocating oscillations of the balance wheel motor into a one-way stepping and driving mechanism. Moreover, the triangular regulating cam of the type depicted in FIG. 4, is provided on the same shaft 40 as the balance wheel rotor, so that when the winding crown is displaced outward, the regulating lever 54 is like the one depicted in FIG. 4, and is forced into engagement with said cam, to allow correction of said timepiece, the inward displacement of said winding crown effecting the release of said triangular cam, to effect a free rotation of said gear train.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic watch comprising electro-mechanical transducer means in the form of a step motor having an electrical driving portion and a mechanical driven portion; driving circuit means operatively coupled to said electrical driving portion of said transducer means for applying a pulse driving signal of alternating polarity thereto for incrementally advancing said mechanical driven portion; and regulating means including regulating cam means operatively coupled to said mechanical driven portion of said transducer means for displacement therewith regulating lever means displaceable between at least a first regulating position in interfering engagement with said regulating cam means and a second normal position out of such interfering engagement, reset switch means operatively coupled to said driving circuit means and displaceable between a first closed reset position and a second open normal position, and means for coordinately displacing said regulating lever means and said reset switch means between their respective first and second positions, said regulating cam means being positioned to orient said mechanical driven portion of said transducer means in a predetermined orientation when engaged by said regulating lever means, said reset switch means and driving circuit means being adapted to apply a first driving pulse of a polarity selected not to drive said mechanical driven portion of said transducer means when said mechanical driven portion is positioned in said predetermined orientation when said reset switch is displaced from its first to its second position so that said mechanical driven portion is first driven by the second pulse applied thereto after displacement of said reset switch means from its first to its second position.

2. An electronic timepiece as recited in claim 1, wherein said driving circuit is adapted to produce a driving signal having a pulse frequency of 1 Hz.

3. An electronic timepiece as recited in claim 1, wherein said coordinate displacement means is adapted to displace said reset switch means from its first to its second position before said regulating lever means is displaced from its first to its second position.

4. An electronic timepiece as recited in claim 3, wherein said reset switch means includes a fixed contact portion and a moving contact portion, said moving contact portion being displaceable between said first and second positions, said regulating lever means and said moving contact portion being formed as a unit.

5. An electronic timepiece as recited in claim 4, wherein said fixed contact portion serves to limit the displacement of the combined moving contact portion and regulating lever means at their respective first positions.

6. An electronic timepiece as recited in claim 1, wherein said electrical driving portion of said transducer means includes a driving coil operatively coupled to said driving circuit for receiving the driving pulse signal therefrom, said mechanical driven portion including a magnetic stator coupled to said driving coil and having poles the magnetic polarity of which are set by the polarity of the respective driving pulses applied to said driving coil and a rotor formed of a plurality of circumferentially spaced magnetic poles positioned for cooperation with the respective poles of a stator, the polarity of said first driving pulse after displacement of said reset switch means from said first to said second position setting the polarity of the poles of said stator such that the rotor is retained in its position, siad second pulse setting the polarity of the poles of said stator such as to incrementally advance said rotor.

7. An electronic timepiece as recited in claim 1, wherein the predetermined orientation of said regulating cam means corresponds to the orientation of said regulating cam means at the zero second position of said mechanical driven portion.

8. An electronic watch comprising electro-mechanical transducer means having an electrical driving portion and a mechanical driven portion; driving circuit means operatively coupled to said electrical driving portion of said transducer means for applying a pulse driving signal of an alternating polarity thereto for advancing said mechanical driven portion; and regulating means including regulating cam means operatively coupled to said mechanical driven portion of said transducer means for displacement therewith, regulating lever means displaceable between at least a first regulating position in interfering engagement with said regulating cam means and a second normal position out of such interfering engagement, reset switch means displaceable between a first closed reset position and a second open normal position to commence application of said pulse driving signal, said first pulse having a predetermined polarity, to said electrical driving portion of said transducer means and means for coordinately displacing said regulating lever means and said reset switch means between their respective first and second positions so that said reset switch means is displaced from its first closed reset position before said regulating lever means is disengaged from said interfering engagement position and displaced from its first to its second position so that said first predetermined polarity pulse of said pulse driving signal is selected not to advance said mechanical drive portion.

9. An electronic timepiece as claimed in claim 8, wherein said mechanical driven portion includes a rotor adapted to be oscillated by said driving portion.

10. An electronic timepiece as claimed in claim 9, wherein a one-way driving member is operatively coupled to said oscillating rotor and to said regulating cam means to be oscillated thereby, and gear train means adapted to be rotated in a single rotary direction, said gear trains means including a first one-way driven member in operative engagement with said one-way driving member, the oscillating motion of said one-way driving member effecting rotation of said driven in single direction.

11. An electronic timepiece as claimed in claim 10, and including a bridge member, and said gear train means including a plurality of gears adapted to be driven in a single rotational direction by said one-way driven member, said plurality of gears and said one-way member being rotatably secured by said bridge member.

* * * * *